United States Patent [19]

Toorell

[11] 4,184,734

[45] Jan. 22, 1980

[54] LAMPHOLDER

[75] Inventor: Sven Toorell, Hok, Sweden

[73] Assignee: AB Coripen, Runstensv., Sweden

[21] Appl. No.: 901,648

[22] Filed: May 1, 1978

[30] Foreign Application Priority Data

May 3, 1977 [DK] Denmark ..... 1932/77
Aug. 19, 1977 [SE] Sweden ..... 7709343

[51] Int. Cl.[2] ..... H01R 13/58
[52] U.S. Cl. ..... 339/210 T; 331/107
[58] Field of Search ..... 339/119 L, 125 L, 208–211, 339/107

[56] References Cited

U.S. PATENT DOCUMENTS 3,609,645 9/1971 Turner ..... 339/210 T X
4,114,971 9/1978 Heimbrock ..... 339/210 R X

*Primary Examiner*—E. F. Desmond

*Attorney, Agent, or Firm*—Hubbell, Cohen, Stiefel & Gross

[57] ABSTRACT

A lampholder, particularly for electric Christmas tree candles, comprises two substantially but not quite similar parts which are united with each other substantially on an axial plane, at least along a major portion of their axial extension. To permit automation of the mounting of contact blades and electric conductors connected thereto in the holder, as well as subsequent assemblage of the lampholder halves, one half only is provided with retention and stress relieving means for firmly holding the contact blades and the stripped ends of the conductors in said one half before as well as after the assemblage of the halves. In one embodiment intended for larger lamp bulbs one lampholder half is longer than the other axially, and terminates in an annular end portion having a through hole for the electric conductors.

13 Claims, 5 Drawing Figures

LAMPHOLDER

BACKGROUND OF THE INVENTION

The present invention relates to a lampholder or socket for electric incandescent lamps which is composed of two halves which are located substantially on each side of an axial plane and united with each other on said plane, at least along the major portion of their extension, and into which a pair of electric contact blades are inserted.

Through the Danish patent specification No. 112 807 a lampholder of this kind is previously known, which is especially intended to be utilized in electric Christmas tree candles and which for enabling quick and easy assembling is divided into two substantially mirror-symmetrical halves along an axial plane, so that contact blades and conductors may be deposited loosely in recesses provided therefor in the halves, after which the two halves are laid together, in that projections or pins of the one half penetrate into corresponding apertures in the other. After that, the lampholder or socket loosely assembled is pushed into a tubular sleeve which holds the socket together and imitates a Christmas tree candle. In this known construction one of the contact blades is carried radially outwards through an aperture in the circumferential wall of the half, while the other contact blade projects axially to an aperture in the composite socket. This socket is difficult to assemble due to the fact that the contact blades are loosely inserted in the halves and that these require an outer tubular sleeve as a means for holding them together.

SUMMARY OF THE INVENTION

The principal object of the invention is to provide a lampholder of the kind in question which permits a substantial simplification of the assembling procedure and thereby a cheapening of the entire lampholder.

With this object in view one of the halves of the lampholder according to the invention is provided with means for holding the two contact blades and the stripped ends of their appurtenant electric conductors before as well as after the two halves have been joined together. This embodiment of the invention is particularly intended for electric Christmas tree candles.

In a modified embodiment which is primarily intended for lamp bulbs having a larger base than Christmas tree lamps one of the two lampholder halves has a greater axial extension than the other half and has a through hole for all electric conductors connected to the lampholder. In this case the two halves are united with each other, in addition to the substantially axially extending joint, on a continuation thereof which preferably forms a substantially right angle with the firstmentioned joint. The through hole is preferably threaded.

At least in the firstmentioned one of the two preferred embodiments of the invention described above said holding means, which clamp the contact blades, which have each initially been connected to an individual conductor wire, in the lampholder half, are constructed in such a way that they on one hand permit automation of the insertion of the contact blades in the lampholder half as well as of the subsequent assembling and joining of the two halves of the lampholder, and on the other hand are capable of retaining the contact blades, even though the conductor wires should be subjected to high tensional loads.

With regard hereto it is essential that the connection between the conductor wires and their insulation on one hand and the respective contact blade on the other hand is sufficiently firm and reliable. Such a connection shall preferably be manufactured automatically and without soldering.

With this object in view each contact blade of the lampholder according to the invention is designed on one hand with one or several tongues which are bent around and firmly clamped on to the insulation of the conductor wire, and on the other hand with one or several tongues which are bent around and clamped around the stripped conductor wire. The clamping of the contact blade tongue(s) around the insulation of the conductor in combination with the fact that the contact blades are held back in the socket brings about an effective retention of the conductor wires against tensional loads, so that further measures for the tensional load relieving are not required. The pinching or clamping operation may be carried out by machine simultaneously with the establishment of the electrical connection between the conductor wire and the contact blade and does thus not require any time consuming labour step.

The lampholder according to the invention is well suited for utilization as an electrical Christmas tree candle or the like as well as for incandescent lamps with a bigger base (E-14, E-27).

Further features and advantages of the lampholder according to the invention will become apparent from the following detailed description and the annexed drawings, which diagrammatically and as non-limiting examples illustrate some embodiments of the invention and in which same reference characters have been used throughout to designate the same or similar details.

DESCRIPTION OF THE PREFERRED EMBODIMENTS

Figure 1:
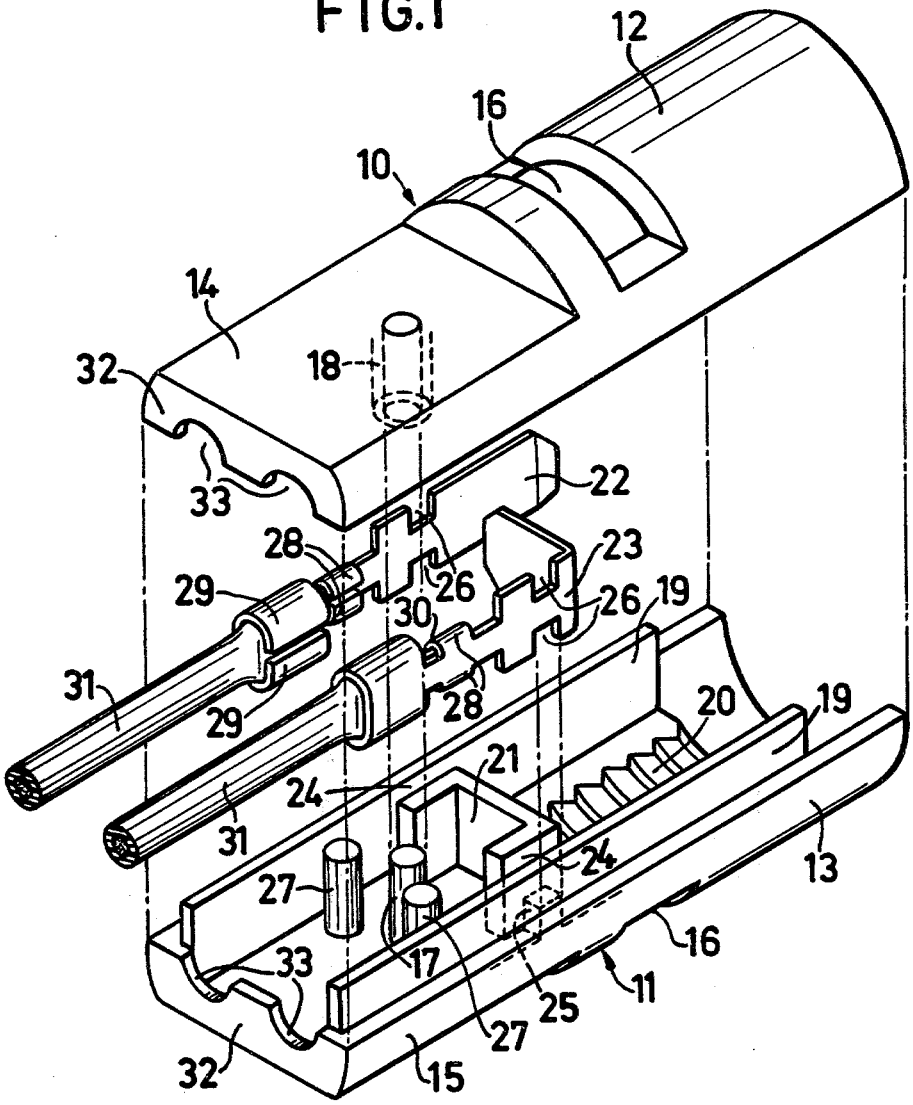
FIG. 1 is an exploded perspective view of a lampholder constructed according to the invention and in first instance adapted to be utilized for electric Christmas tree candles.
Figure 2:
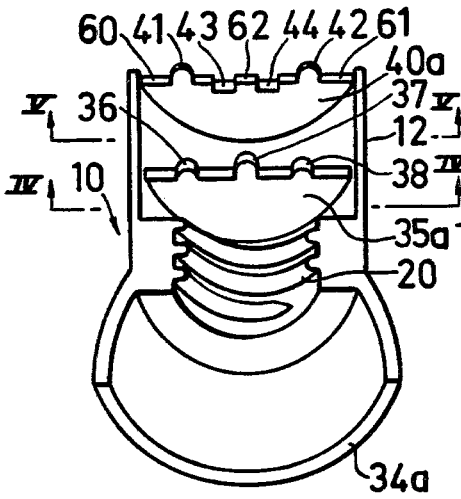
FIGS. 2 and 3 illustrate each in perspective one individual one of two halves which together form a lampholder according to the invention which is intended for larger incandescent lamps, e.g. lamps having an E-14 or E-27 base.

The lampholder or socket illustrated in FIG. 1, which in the first instance is intended for electric Christmas tree candles, consists of two halves 10 and 11, which may be manufactured by molding or the like of a suitable plastic material and which have each a semi-cylindrical portion 12 and 13 and a flat portion 14 and 15, respectively. In the outer, semi-cylindrical surface of each portion 12 and 13 a recess 16 is provided which is intended to cooperate with elastically resilient projections on the inside of a lamp housing (not shown), which e.g. may be a tubular imitation of a Christmas tree candle, for releasable holding of the composite socket in the housing in a manner known per se.

On the inside of its flat portion 15 one half 11 is provided with a retaining pin 17, which fits tightly in and penetrates into a sleeve 18 during the joining of the halves, said sleeve being formed on the inside of the flat portion 14 of the other half 10. Furthermore, said one half 11 is formed with guide ribs 19 which extend along the side wall and which during the joining together of the halves abut the substantially plane insides, which are not visible on the drawing, of the side wall of the other half 10.

The cylindrical portion 12 and 13 of each half is formed with an internal thread 20 for receiving a lamp bulb base. The bottom of the threaded hole is comprised of the transverse wall or web of a U-shaped projection 21, which projects from the flat portion 15 of said one half 11 and whose side walls, which face away from the threaded hole 20, are parallel to and located at a small distance from the guide ribs 19. The interspace 24 between these side walls and guide ribs serves for receiving and clamping an individual one of two contact blades 22 and 23, respectively, of which one 22, which is substantially plane, is intended to establish electric contact with the shell contact or thread of a lamp bulb which is threaded into the socket, while the other contact blade 23, which is bent substantially in a right angle, is intended to establish contact with the centre contact element of the lamp bulb. In the bottom of each of said interspaces 24 there is a retaining tooth 25, of which only one is shown in the drawing, and these retaining teeth penetrate into corresponding notches 26 in the lateral edges of the contact blades. As is apparent from FIG. 1 such notches are provided in both lateral edges of each blade, the other half 10 being formed with teeth (not shown) corresponding to the tooth 25. For further guidance of the contact blades there are provided two guide pins 27 on the flat portion 15 of the half 11, which are located at a small distance from the guide ribs 19 and serve to maintain the rearmost portions of the contact blades in engagement with the guide ribs and thus further clamp the contact blades in the holder. On account of the projection 21, the guide ribs 19 and the pins 27 the halves 10 and 11 are unsymmetrical.

At its rear end each contact blade 22 and 23 has two pairs of lateral tongues 28 and 29, respectively, which are located right opposite each other and of which the firstmentioned ones 28 are relatively short and bent in towards each other for clamping the stripped end of an insulated current supply lead or conductor 31, while the rear tongues 29 are relatively long and bent in towards each other around the conductor insulation for clamping the conductor wire 31.

The flat portion 14 and 15, respectively, of the two halves has an end wall 32 with spaced semicircular cut outs 33, which in the composite socket or lampholder form apertures, through which the conductor wires 31 may pass without becoming jammed.

It is obvious that the contact blades 22, 23 are firmly held in place in the assembled socket by the retaining means 19, 21, 27 before as well as after the halves 10, 11 have been assembled, and that the conductor wires 31 likewise are firmly secured to the contact blades so that both the conductor wires and contact blades are capable of withstanding great tensional loads. It is also recognized that any traction in the conductor wires is essentially taken up by the clamping tongues 29 and that a very minor part of the tractional force is transferred to the contact forming tongues 28.

The lampholder illustrated in FIGS. 2–5 which in the first instance is intended for incandescent lamp bulbs having a larger base than those shown in FIG. 1 comprises, like the embodiments of the invention described above, two halves 10, 11, which basically are located on opposite sides of a diammetrical plane and each has a substantially semi-cylindrical portion 12 and 13, respectively, provided with threads 20 for an incandescent lamp bulb base. In its upper end the two halves are terminated by a truncated, conically widening flange portion **34*a* and 34*b***, respectively. These portions form together a collar or the like which surrounds the lower portion of an incandescent lamp bulb threaded into the lamp holder.

The bottom of the through hole provided with threads 20 is formed by a shelf which is comprised of two shelf portions **35*a* and 35*b*. The shelf portion 35*a*, which belongs to the half 10, has substantially the shape of a segment of a circle which is less than a semicircle, as is apparent from FIGS. 2 and 4. The shelf portion 35*a* has three projections 36, 37, 38 which are substantially located in the plane of the shelf portion and project substantially perpendicularly to the secant defining the shelf portion 35*a*. The two outer (lateral) projections 36 and 38 are substantially shorter than the intermediate, central projection 37 and are located approximately symmetrically with respect thereto. In its lower end the half 10 is terminated by a bottom or shelf portion 40*a*, which like the shelf portion 35*a* has the shape of a segment of a circle which is less than a semicircle, as is evident from FIGS. 2 and 4. The shelf portion 40*a* is, along its defining secant provided firstly with two symmetrically located projections 41 and 42, secondly with two likewise symmetrically located recesses or notches 43 and 44 which are located intermediate the projections 41 and 42**.

Figure 3:
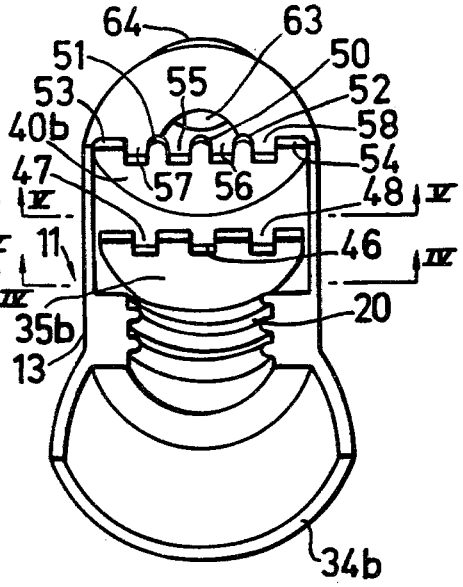
Figure 4:
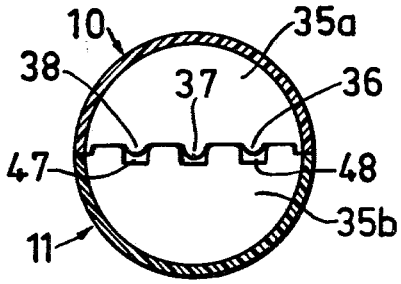
FIGS. 4 and 5 are cross sections on lines IV—IV and V—V, respectively, in FIGS. 2 and 3 through the two lampholder halves in assembled condition.
Figure 5:
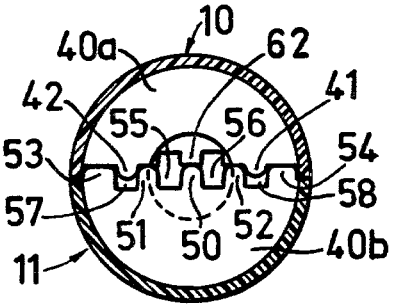

The other half of the lampholder, which is illustrated in perspective in FIG. 3, is also provided with two shelf portions **35*b* and 40*b* which correspond to and supplement the shelf portions 35*a* and 40*a*, respectively. The shelf portion 35*b* has a central notch or recess 46 which is intended to cooperate with and receive the central projection 37 of the shelf portion 35*a*, and two narrow notches or recesses 47, 48 which are located symmetrically on opposite sides of the central projection 37 on the same mutual distance therefrom as are the projections 36, 38 of the shelf portion 35*a*, with which they are intended to cooperate, as is evident from FIG. 4. The recesses 46–48 of the shelf portion 35*b* form four tongues which project past a diametrical plane, which means that the shelf portion becomes larger than a semicircle. The shelf portion 40*b* has a central projection 50 and two pairs of projections 51, 52 and 53, 54, respectively, which are symmetrically located with respect to the central projection. Between said projections there are formed symmetrically located recesses or notches 55, 56 and 57, 58. A plane which is diametrical in relation to the shelf portion 40*b* intersects all projections and recesses 50–58**.

When assembling the halves 10 and 11 the two projections 41, 42 of the half 10 engage the recesses 58 and 57, respectively, of the half 11, and the projections 53, 54 of the half 11 engage the recesses 61, 60 located outside the projections 42 and 41, respectively, in the half 10. Furthermore, the outer portion of the central tongue 62 located between the recesses 43, 44 in the shelf **40*a* abuts the outer portion of the central projection 50 of the shelf 40*b*. The recesses 43, 44 form together with the recesses 56 and 55, respectively, two through, substantially rectangular apertures. These continue in a common, preferably threaded hole 63 in an annular end flange or collar 64, which in its entirety is comprised in the half 11** in accordance with the invention.

In the composite lampholder the contact blades 22, 23 (not shown in FIGS. 2–5), which are entirely identical to the blades shown in FIG. 1, engage the recesses 48, 47 of the shelf portion **35*b* with one of their notches 26 (FIG. 1). On the opposite side (with respect to the shelf portion 35*b*) of the narrower contact blade portions located right opposite the recesses 26, the projections 36, 38 of the shelf portion 35*a* also engage the recesses 48 and 47, respectively, of the shelf portion 35*b*. The wider contact blade portions located on opposite sides of the recesses 26 (as seen in the longitudinal direction of the blades) engage above and below the shelf portions 35*a*, 35*b*, respectively, whereby the contact blades are retained against tractional forces which tend to pull the blades out of the lampholder. The outer tongues 29 of the contact blades which grip the insulation of the conductor wire 31 penetrate into and are retained by the rectangular apertures 43+56 and 44+55 in the composite lampholder. The shelves 35*a*+35*b* and 40*a*+40*b* accordingly form fastening means for the contact blades. The two halves 10, 11** of the lampholder may be united in any suitable manner, e.g. by being melted or fused together by means of a solvent for the lampholder material or the like or by being welded together, preferably by means of ultrasonic welding. Alternatively, the halves may be glued or screwed together.

The embodiments described above and shown in the drawings are of course, to be regarded merely as non-limiting examples and may as to their details be modified in several ways within the scope of the following claims. Thus, a stop screw may for example be provided for a bushing, which is screwed into the threaded hole 63 and which belongs to a lampstand or the like. Furthermore, new embodiments, which are also within the scope of the invention, may be created by combining details, which are taken from different ones of the exemplificatory embodiments described above, in a suitable manner.

What I claim is:

1. Lampholder for electric incandescent lamps comprising two halves which are located substantially on each side of an axial plane, and a pair of electric contact blades inserted into said lampholder, one of said halves being provided with means for holding the two contact blades and a stripped end of an insulated electric conductor connected to each of said contact blades, each of said contact blades being provided with at least one first tongue which is bent around and clamped on to the insulation of one of said insulated conductors connected to one of said contact blades, and with at least one second tongue which is bent around and clamped on to said stripped end of said conductor, characterized in that said holding means comprise a first pair of mutually cooperating fastening means for pinching each of said first tongues and the enclosed insulated conductor between themselves, and a second pair of fastening means for pinching each of said second tongues and the enclosed stripped conductor ends between themselves.

2. Lampholder according to claim 1, characterized in that said first pair of fastening means and said second pair of fastening means having one fastening means in common.

3. Lampholder according to claim 1, characterized in that the halves of the lampholder are mutually unsymmetrical, mainly due to the presence in one of said lampholder halves of said holding means for the contact blades.

4. Lampholder according to claim 1, comprising mutually cooperating engagement means in each of said two lampholder halves for holding said halves together into one unit.

5. Lampholder having a socket for an incandescent lamp bulb, a center contact blade, a shell contact blade, retaining means for holding said contact blades and insulated electric conductors having stripped ends connected to said contact blades in the lampholder, said lampholder comprising two halves united with each other on a substantially axial plane along a major portion of their axial length, one of said halves having a greater axial extension than the other and having an annular end portion with a through hole for said electric conductors connected to the lampholder.

6. Lampholder according to claim 5, wherein each of said contact blades has a pair of opposed, laterally projecting tongues which are bent around and enclose the stripped end of an individual one of said conductors, and said retaining means comprise a gap in which said tongues and said enclosed stripped conductor end are gripped.

7. Lampholder according to claim 5, characterized in that said through hole for the electric conductors comprises an outer threaded portion and an inner portion which is comprised of two partial openings each of which surrounds an individual one of the outer ends of said two contact blades.

8. Lampholder according to claim 7, characterized in that said third and fourth shelf parts together define said partial openings forming the inner portion of said through hole.

9. Lampholder according to claim 5, characterized in that said halves are united with each other on said substantially axial plane and in addition thereto on a substantially radial plane.

10. Lampholder according to claim 5, wherein said retaining means are arranged in one lampholder half only and almost in their entirety are located on one side of said substantially axial plane separating those portions of the lampholder halves from each other which are located nearer said socket than said annular end portion is.

11. Lampholder according to claim 10, comprising a first shelf part in one of said lampholder halves, said first shelf part extending substantially in a radial plane and having lateral notches directed towards the other lampholder part; a second shelf part in the other lampholder half, said second shelf part extending substantially in the same radial plane as said first shelf part and having lateral projections located just opposite said notches of said first shelf part and forming together therewith clamping means for holding said contact blades in the lampholder.

12. Lampholder according to claim 11, comprising a third shelf part, extending substantially in a radial plane adjacent to said and having first shallow lateral recesses directed towards the other lampholder half annular end portion; and a fourth shelf part in the other lampholder half, said fourth shelf part extending substantially in the same radial plane as said third shelf part and having second shallow lateral recesses located just opposite said first shallow recesses of said third shelf part and forming together therewith clamping means for holding the outer portions of said contact blades as well as said conductors in said lampholder.

13. Lampholder according to claim 12, characterized in that said third and fourth shelf parts together define said partial openings forming the inner portion of said through hole.

* * * * *